United States Patent [19]

Woythal

[11] 4,305,184

[45] Dec. 15, 1981

[54] CONTROL OF SKEW, BOW AND YIELD IN CIRCULARLY KNIT PILE FABRIC

[75] Inventor: Gerald C. Woythal, Greenfield, Wis.

[73] Assignee: Bunker Ramo Corporation, Oak Brook, Ill.

[21] Appl. No.: 53,585

[22] Filed: Jun. 29, 1979

Related U.S. Application Data

[62] Division of Ser. No. 3,598, Jan. 15, 1979, abandoned.

[51] Int. Cl.[3] ..... D06C 3/00

[52] U.S. Cl. ..... 26/51.5; 26/74; 66/147

[58] Field of Search ..... 26/51.4, 51.5, 74; 28/170; 66/147

[56] References Cited

U.S. PATENT DOCUMENTS

| | | | |
|---|---|---|---|
| 1,767,762 | 6/1930 | Jennings | 66/147 |
| 2,092,340 | 9/1937 | Tandel | 26/74 |
| 2,343,328 | 3/1944 | Robertson et al. | 26/51.5 |
| 2,638,656 | 5/1953 | Tuttle et al. | 26/51.5 |
| 2,737,700 | 3/1956 | Thompson | 26/51.5 |
| 3,077,656 | 2/1963 | Mahlo | 26/51.5 |
| 3,193,688 | 7/1965 | Morton et al. | 26/51.5 |
| 3,533,144 | 10/1970 | Jaffe et al. | 26/74 |
| 3,717,909 | 2/1973 | Robertson | 26/51.4 |
| 3,999,405 | 12/1976 | Abler et al. | 66/147 X |

FOREIGN PATENT DOCUMENTS

| | | | |
|---|---|---|---|
| 2320492 | 11/1974 | Fed. Rep. of Germany | 66/147 |
| 418004 | 2/1967 | Switzerland . | |
| 671515 | 5/1952 | United Kingdom . | |
| 692981 | 6/1953 | United Kingdom . | |
| 953160 | 3/1964 | United Kingdom . | |
| 1223232 | 2/1971 | United Kingdom . | |
| 1399319 | 7/1975 | United Kingdom . | |
| 1456834 | 11/1976 | United Kingdom . | |
| 1531361 | 11/1978 | United Kingdom . | |

*Primary Examiner*—Wm. Carter Reynolds
*Attorney, Agent, or Firm*—N. A. Camasto; J. W. Klooster

[57] ABSTRACT

Control of skew, bow and yield in circularly knit pile fabric is accomplished by providing the fabric tube as knit and before longitudinal slitting with identification mark means so aligned with respect to selected longitudinally spaced courses that after the fabric tube has been slit and spread out flat for tentering, skew, bow and yield can be readily controlled in response to detecting means for viewing the identification mark means.

2 Claims, 8 Drawing Figures

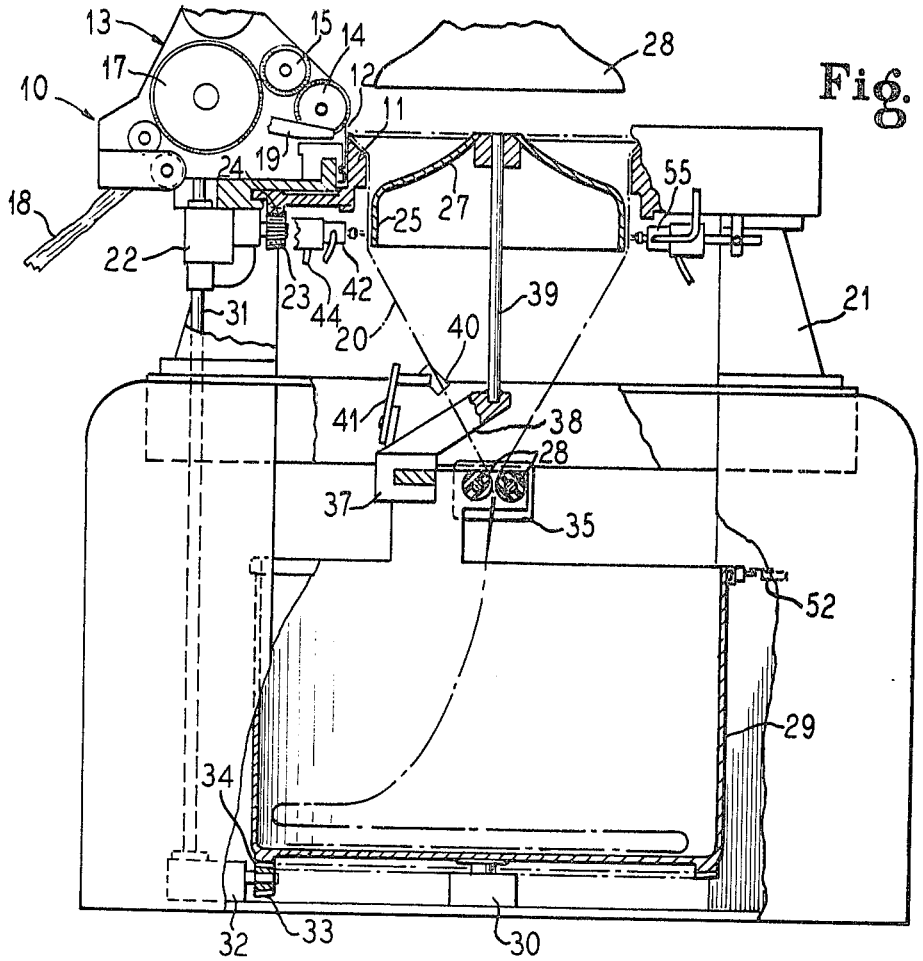
Fig. 1
Fig. 2
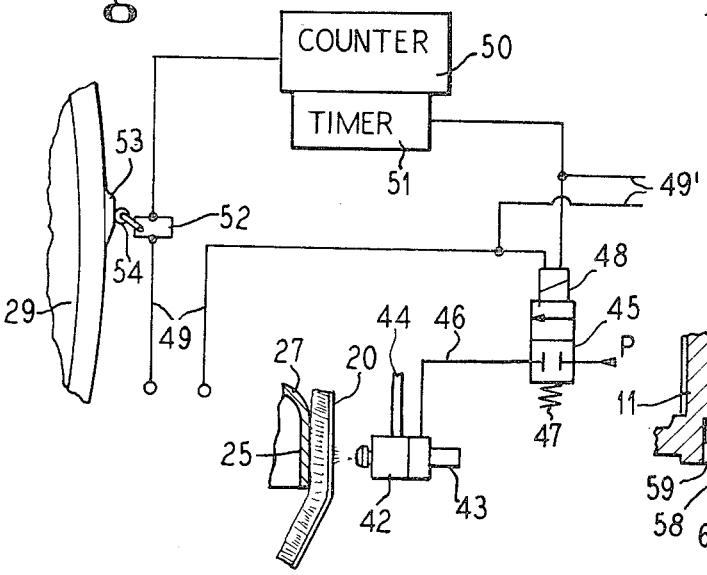
Fig. 3
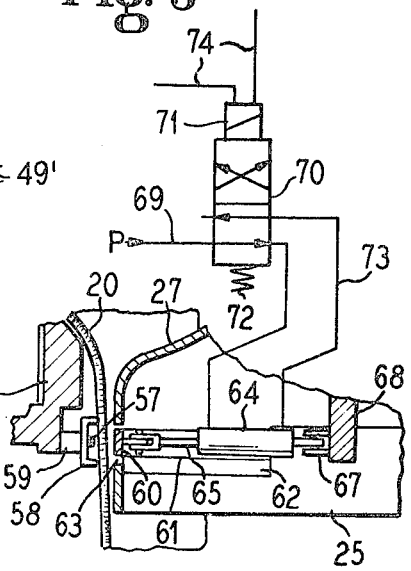

CONTROL OF SKEW, BOW AND YIELD IN CIRCULARLY KNIT PILE FABRIC

This is a divisional application of application Ser. No. 003,598, filed Jan. 15, 1979, now abandoned.

BACKGROUND OF THE INVENTION

This invention relates to new and improved method of and means for controlling skew, bow and yield in circularly knit pile fabric, and more particularly for controlling those conditions during advance of the split and spread web or strip of the fabric incident to tentering.

The problems of skew, bow and yield have been present in the production and treatment of circularly knit pile fabrics from the beginning of such production, and have become more critical since the introduction of patterned knit pile fabrics.

In the production of deep pile fabric in a circular knitting machine, course after course is knit by means of a rotating needle cylinder, and fibers are incorporated in the stitches as the yarn is knit into the fabric. Prior to the formation of a stitch, each of a number of needle hooks rises into carded fiber on the surface of a respective doffer roll, engaging and drawing down a tuft of fiber which is to be incorporated into the stitch. An air jet blows over each needle as the stitch is being formed to aid in orienting the fibers taken by the needle and causing the ends of the fibers to stream toward the center of the tubular form of the knit fabric whereby the pile is developed at the inner surface of the tubular form and the outer surface of the tubular form is free from pile and serves as the back of the fabric. Beyond the needle cylinder, either in the knitting machine or subsequently, the knitted pile fabric tube is slit longitudinally, so that for further processing the fabric can be handled in a spread apart web or strip. By way of example, apparatus is disclosed in U.S. Pat. No. 3,999,405, in which slitting is efficiently done in the same machine sequentially after the circular pile fabric knitting step, and for convenience, the present disclosure will be related to this type of apparatus.

For further processing, the slit tubularly knit pile fabric is spread out to generally flattened condition and run through a tenter. Because of the nature of the knit fabric, skew, bow and yield present special problems which are aggravated where the pile fabric is patterned. Generally, manual controls have been employed requiring constant observation and manual correction of the moving fabric, but resulting in up to 30% rejection of fabric and thus substantial economic loss. The majority of rejects have been for too much skew, although bow and yield complicate the situation.

Various attempts have been made heretofore in the woven fabric industry to alleviate the problems of skew, bow and yield, but they have not solved the problem for tubularly knit pile fabric, and particularly deep pile patterned knit fabric. One prior example for automatic weft straightening control is found in U.S. Pat. No. 2,638,656, wherein flat woven fabric is provided with relatively wide transverse stripes of fluorescent or phosphorescent pigments extending entirely across the fabric at spaced intervals to be detected by invisible or black light rays for operating weft or bow straightening apparatus upstream from a tenter.

Alleged attainment of substantially uniform yield in woven fabric as it is being variously processed and tentered is disclosed in U.S. Pat. No. 3,839,767, wherein variations in fabric density are detected and corrected by an elaborate mechanical arrangement.

Arrangements such as those in U.S. Pat. Nos. 2,638,656 and 3,839,767 do not satisfactorily meet the special conditions present in respect to circularly knit pile fabric and in particular deep pile patterned knit fabric.

SUMMARY OF THE INVENTION

An important object of the present invention is to overcome the disadvantages, drawbacks, inefficiencies, shortcomings and problems heretofore inherent in the handling of slit circularly knit pile fabric having regard to the control of skew, bow and yield.

Accordingly, the present invention provides a method of and means for providing circularly knit pile fabric with skew control identifications, whereby before the circularly knit pile fabric has been slit, detectable identifications are provided at accurately longitudinally spaced intervals on a longitudinal area of the fabric, so that after longitudinally slitting the circularly knit fabric along the longitudinal area, the identifications will be in part on the selvage along one side of the slit and in part on the selvage on the other side of the slit.

The skew control identifications may efficiently be in the form of detectable marking lines across the longitudinal area of the tubular form circularly knit pile fabric, and after slitting respective parts of the marking lines will be on one of the selvages and the other parts of the lines will be on the other of the selvages. In the absence of skew, the separated parts of the lines will be in a desired alignment, and on observation of misalignment of the respective parts of the lines on the selvages skew controlling means can be operated to correct the skew during longitudinal advance of the fabric for tentering. For detection by bow controlling means during longitudinal tentering advance, detectable mark means are applied along a central longitudinal portion of the tubular fabric and aligned with the marking lines.

The slit, marked circularly knit pile fabric is adapted to be spread apart with the marked selvages at opposite longitudinal edges of the spread fabric. Observation of the identifications, i.e. the marks on the selvages of the fabric running longitudinally toward a tenter enables effecting corrections in skew of the running fabric. Such corrections are desirably effected automatically in response to signals from detecting means associated with the tenter for controlling skew correcting, bow correcting, and yield correcting devices operating on the running fabric, that is the fabric advancing with respect to the tenter.

Because circularly knit pile fabric, and particularly such fabric having patterned pile is unusually susceptible to skewing, bowing and yield variations after slitting of the tubularly knit form, accuracy in placement of the detectable identifications on the fabric is most efficiently accomplished in the circular pile fabric knitting apparatus in any of numerous ways while the circularly knit fabric is under sufficient control to provide the detectable identifications in, on and in alignment with selected longitudinally spaced knit courses. By way of example, the detectable identifications may be printed on the back of the fabric, or may be knitted into the fabric pile where the knitting machine has pattern capability so that the anchored bights of the selected identification mark fibers will be detectable at the back of the fabric. The identification may be directly knitted into the courses of the fabric back through yarn-control means wherein a small segment of the yarn may be dyed, impregnated or otherwise combined with a detectable type of substance and so timed as to be knitted into the desired courses. If preferred, the yarn-control means may introduce a small segment of detectable yarn at the desired courses, along with the backing yarn to provide course identification marks. The course identification marks may also be applied by liquid application, such as by means of a blowgun or other spraying device. The identifications may be visible or invisible to the naked eye using a preferred compound or chemical, may be in the form of reflective tape or liquid, a magnetic-type ink, or any other kind of marking means detectable in any suitable manner.

Whatever may be the preferred form of the detectable identifications, a particularly efficient method of providing the same at accurately longitudinally spaced intervals on the tubular form of the circular pile fabric is during the knitting process while the tubular fabric is under thorough control ahead of the slitting operation, whether the slitting is accomplished as a continuous operation in the knitting apparatus or after the fabric has been knit and removed from the knitting apparatus to a slitter.

BRIEF DESCRIPTION OF THE DRAWINGS

Other objects, features and advantages of the invention will be readily apparent from the following description of certain representative embodiments thereof, taken in conjunction with the accompanying drawings although variations and modifications may be effected without departing from the spirit and scope of the novel concepts embodied in the disclosure and in which:

FIG. 1 is a fragmentary, somewhat schematic, sectional elevational view of a circular knitting machine combining circular knitting and longitudinal slitting functions, and embodying principles of the present invention.

FIG. 2 is a schematic illustration of a control system related to application of identification marks to the cylindrically knit pile fabric.

FIG. 3 is a schematic view illustrating a modified identification mark applicator and control means therefor.

DETAILED DESCRIPTION

Figures 4, 5, 6:
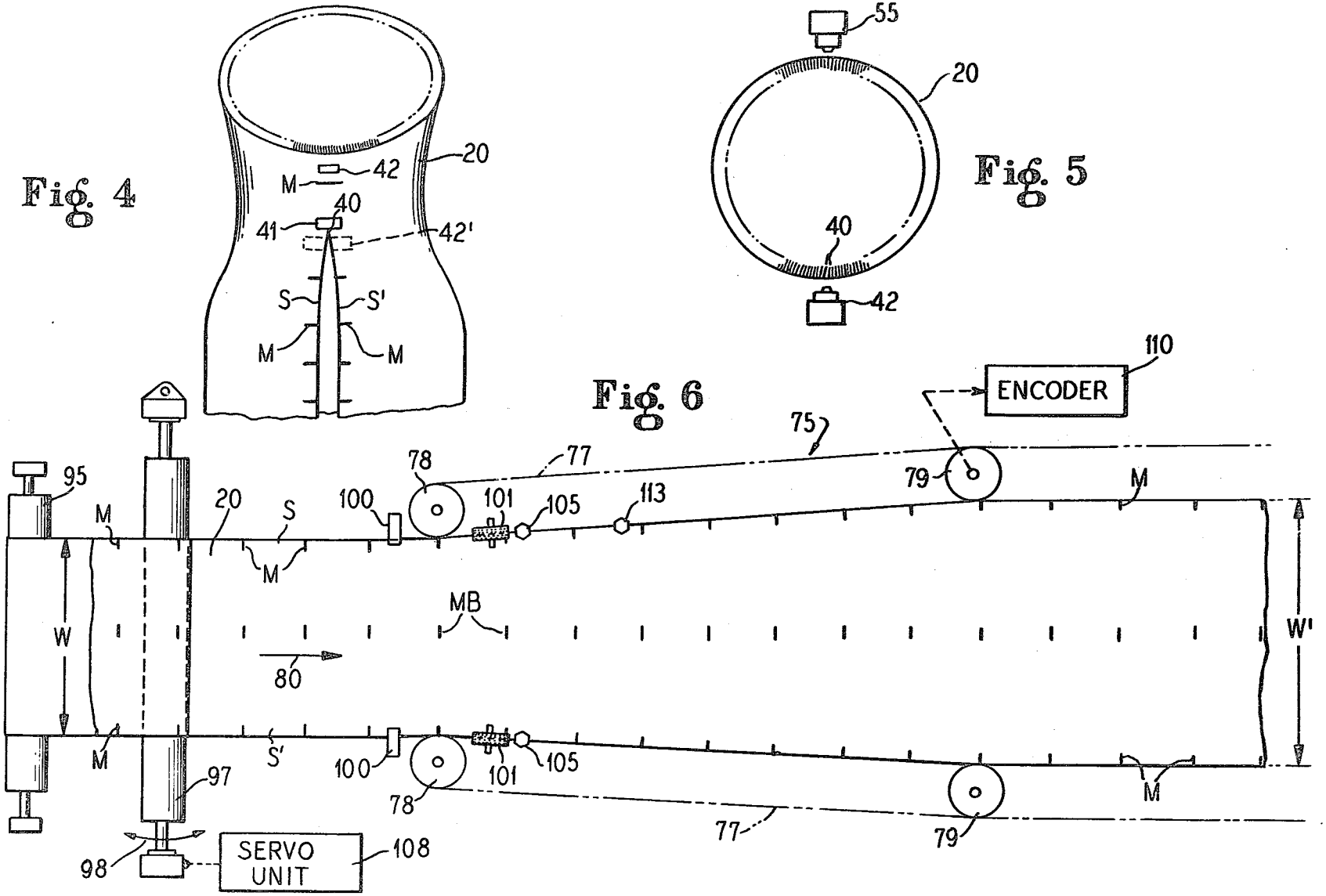
FIG. 4 is a schematic perspective view illustrating more graphically identification mark applying and slitting of the tubular knitted pile fabric in the knitting machine.
FIG. 5 is a schematic top plan view, of FIG. 4, showing the cooperative relation of various identification mark applying means.
FIG. 6 is a schematic plan view of a tenter arrangement and related identification mark scanning and skew control means.

By way of example, features of the invention are illustrated as embodied in or in connection with a deep pile circular knitting machine 10 having a rotary needle cylinder 11 operatively carrying vertically reciprocating knitting needles 12 and operating in conjunction with other devices well-known in the art including a plurality of fiber supply stations 13 at circumferentially spaced locations about the cylinder 11, only one of such fiber supply stations being shown by way of illustration. In the rotary operation of the cylinder 11, the respective needles 12 rise in a programmed manner into the card clothing of respective doffer rolls 14 at the supply stations and which are supplied in conventional manner with the desired carded fiber by means of respective intermediate rolls 15 taking the fiber from respective carding rolls 17 to which the fiber is delivered in usual manner from sliver supply 18. As each needle reciprocates upwardly into the card clothing of the doffer 14, in each instance, the needle draws down a tuft of the fiber which is incorporated into a stitch of yarn supplied in the usual manner to the needles. An air jet from a nozzle 19 blows over the needle, causing the ends of the fibers to stream toward the center of the cylinder as the tuft of fiber is being knitted into the stitch. This causes the pile of fabric to be on the inside of the tubular knit fabric identified as 20. In this manner, as the tubular fabric 20 is progressively knit course after course, the fiber pile being on the inside of the tube, the outside of the tube presents a backing for the fabric.

Support for the knitting cylinder 11 and the fiber supply stations 13 is provided by a machine frame 21 which mounts suitable means for driving the cylinder 11 rotatably such as a power transmission 22 driving a spur gear 23 meshing with a ring gear 24 attached to the cylinder 11.

Below the needle cylinder 11, the tubular knit fabric 20 passes downwardly along a depending annular flange 25 of a generally bell shaped baffle 27 which prevents stray fibers from entering into the fabric tube and diverts such fibers upwardly into a suction exhaust hood 26.

Take-down rollers 28 continuously pull the knitted fabric 20 downwardly into a receiving basket or tub 29 which is rotatably mounted on its bottom on a thrust bearing 30 and is rotatably driven in synchronism with the cylinder 11 as by means of a power take-off shaft 31 extending from the power drive 22 to a right angle drive 32 which drives a pinion 33 meshing with a ring gear 34 on the lower edge of the bottom wall of the tub 29. This arrangement permits the take-down rollers 28 and rotary drive means 35 therefor to be mounted on bracket structure 37 carried by the tub 29. Through support means 38 the bracket structure 37 mounts a fixed vertically upwardly extending shaft 39 coaxial with the tub 29 and the baffle 27 and supporting the baffle 27 for corotation with the tub 29 and the cylinder 11.

Under the tension provided by the take-down rollers 28, the tubular fabric 20 is continuously slit longitudinally by a slitting blade 40 mounted fixedly on the bracket structure 37 as by means of adjustable blade bracket 41. Although slitting of the tubular fabric 20 is most conveniently effected, as described, by means of the blade 40 functioning at a location intermediate the take-down rollers 28 and the baffle flange 25, slitting of the fabric tube may be effected at a subsequent time after a suitable length of the tubular fabric has been fabricated and accumulated in the tub 29 from which tub the fabric may then be removed for subsequent processing.

Irrespective of when the tubular fabric 20 is longitudinally slit for the customary purpose of spreading the fabric into flattened strip form for tentering and the like, the tubular fabric is provided with detectable identifications at substantially accurately longitudinally spaced intervals or courses for use in the control of skew, bow and yield during tentering. As pointed out hereinbefore, providing of the detectable identifications may be effected in numerous ways within the purview of the present invention. However, by way of specific example, certain methods and means for providing the identifications will now be described in detail, as being especially efficient in association with the circular deep pile knitting machine 10.

In one desirable embodiment, the detectable identifications are applied to the backing or jersey face of the fabric 20 by means of an applicator 42 which may be in the form of a spraying device or gun mounted on the machine frame 21 in a suitable position such as at an elevation opposite the annular baffle flange 25 serving as a back-up for the fabric as it passes between the spray nozzle of the device 42 and the flange 25. In this location, application of the identifications is effected while the tubular fabric 20 is unslit so that the identifications are applied only to the back surface of the fabric without liability of impinging on the pile at the pile surface of the fabric. This is especially important where visible ink or dye type of medium is used, and may not be as important a consideration where an ocularly invisible marking medium is used requiring a light sensitizing device for detection. In the latter instance, application of the identification medium may be effected downstream from the slitter 40 while the fabric 20 is held under steady tension with the knit courses of the fabric in substantial alignment at the slit and before spreading apart of the fabric at the slit. In any event, application of the identifications in the form of marks is preferably effected at substantially accurate predetermined longitudinally spaced intervals on a longitudinal area of the fabric 20 along which the fabric is slit as by means of the slitter 40. Spray guns of the type which will serve for the device 42 are readily available commercially and operable intermittently under valve control or pressure supply control, as may be preferred.

Operation of the applicator device 42 is effected, according to one preferred system or arrangement in coordinated relation with rotation of the fabric tube 20 with the cylinder 11 and the tub 29 to apply the identifications as nearly as practicable accurately at predetermined spaced intervals along the longitudinal slitting area of the fabric and in such a manner that when the fabric is slit along such longitudinal area, the selvages will each have part of the identification marks on the same severed course or courses of the fabric to which the mark has been applied. For example, referring to FIG. 4, the marking device 42 is desirably operated to apply narrow detectable identification marks M to extend across the longitudinal slitting area of the tubular fabric 20. The length and orientation of the marks M on the longitudinal slitting area is such that after the web is slit whereby to provide respective opposite selvages S and S′, one part of each of the marks M remains on the selvage S and the remaining part of each of the marks M remains on the opposite selvage S′.

Although in preferred arrangement, the applicator 42 is located to apply the successive longitudinally spaced marks M to the fabric 20 upstream from the cutter 40, if for any reason it is desired to apply the marks M downstream from the cutter 40 while the fabric 20 is still under adequate tension applied by the take-down rollers 28 to maintain the courses of the fabric at the selvages S and S′ substantially aligned, the applicator may be located downstream adjacent to the cutter as indicated in dash outline at 42′. However since there is a tendency of the selvages S and S′ to pull apart as a result of flattening of the tubular fabric by the take-down rollers, location of the applicator at 42′ must be evaluated from the standpoint of any possible detrimental effect of marking material possibly entering the fabric tube during application. Of course, where the marking material is of an ocularly invisible type entrance of any of the material into the tube to the pile of the fabric may present no problem.

Means are provided for actuating the applicator 42 (or 42′) in timed sequence coordinated with operation of the circular knitting machine 10 to apply the identification marks M at substantially accurately spaced longitudinal intervals along the longitudinal slitting area on the tubular fabric 20 as course after course of knitting progresses at the speed of operation of the machine. As schematically shown in FIGS. 1 and 2, the spray applicator 42 is mounted on the machine frame 21 at the selected fixed location by means of a bracket 43 and is adapted to receive fluid marking material from any suitable source such as a tank (not shown) through a conduit 44. Under the control of an on-off valve 45, compressed air from a suitable source P is adapted to be delivered to the applicator 42 through an air line 46. The valve 45 is normally biased as by means of a spring 47 into an "off" position, from which the valve is adapted to be shifted into an "on" position by means of a solenoid 48. Means for timed sequential operation of the solenoid 48 to shift the valve 45 into the "on" position comprise a suitable counter/timer controlled electrical power conduit 49 having therein a counter 50, a connected timer 51 and a control switch 52 which may be of the microswitch type. In one desirable arrangement, the control switch 52 is mounted on the machine frame 21 at a suitable location to be actuated once in each complete revolution of the circularly knit fabric 20 in the machine. For example, the switch 52 may be mounted adjacent to the upper rim of the tub 29 which is equipped with a radially outwardly projecting actuator cam 53 with which a switch actuator 54 engages for a limited interval in each revolution of the tub 29. At each actuation of the switch 52, the counter 50 is pulsed. After a predetermined number of pulses equivalent to a predetermined length addition of courses to the knit tubular fabric 20, the timer 51 is triggered to close the electrical circuit 49 to the solenoid 48 which as thus energized shifts the valve 45 to the "on" position for a time interval just long enough to activate the applicator sprayer 42 to impinge one of the identification marks M onto the back of the knit pile fabric 20. Where the spray nozzle of the applicator 42 is of a type which produces a fan spray of sufficient desired width for each of the marks M, activation of the applicator 42 may be as a momentary pulse to apply the mark M instantly at the proper predetermined location as the fabric 20 continues to rotate. Where the applicator 42 is of the pencil line brush type, timed operation of the applicator may be effected for a suitable time interval to continue in operation long enough to accomplish application of the length of line desired in each of the successive marks M. The applicator 42 may be of the type wherein the control valve 45 operates to control the nozzle of the applicator 42, and the marking material may be under continuous pressure in the applicator to be released from the nozzle by operation of the valve 45 as controlled by the timer 51, as described.

In addition to the identification marks M which, as will be presently described, are useful in detecting and correcting skew and yield deviations from a predetermined norm in tentering of the fabric 20 after it is spread out for that purpose, the fabric 20 may be, and desirably is, provided with additional identifications for further control purposes, such as marks MB (FIGS. 6 and 7) which are advantageous for detecting and controlling bow deviations in the web during tentering. By preference, the marks MB are provided at successive intervals along a central longitudinal area of the fabric 20 which is diametrically opposite, in the tubular form of the fabric, to the slitting area on which the marks M are provided. In a preferred arrangement, the marks MB are transversely aligned with the marks M so that when the fabric 20 is spread out, the marks MB will be in straight alignment between the portions of the marks M on the selvages S and S'. If preferred, the marks MB may be applied to the fabric 20 by operation of the applicator 42 for this purpose in the same rotation of the fabric 20 as that in which the marks M are applied. However, greater accuracy is attained in placement of the marks MB by applying the same from a separate applicator 55 which may be of the same kind as the applicator 42 and operated synchronously with the applicator 42 by means of the counter-timer circuit as the timer 42, being for this purpose connected in the electrical circuit 49 by means of the parallel circuit 49'. It will be appreciated that for this purpose, the applicator 55 may be equipped with marking medium supply means and control means the same as or similar to those associated with the applicator 42. Thus in each timed sequential operation of the applicator 42, the applicator 55 will be simultaneously operated to attain utmost accuracy in application of the marks MB in alignment with the marks M.

In another embodiment of marking means suitable for the present invention, as shown in FIG. 3, means are provided for stamping the identification marks on the circularly knit fabric. Such stamping means may conveniently comprise a marking medium carrying and transfer pad 57 supported in a holder 58 mounted as by means of a bracket 59 in a desirable fixed location on the lower part of the inner side of the needle cylinder 11. Cooperatively related to the transfer pad 57 is a thruster 60 mounted inside of the fabric tube 20 in alignment with the transfer pad 57 and adapted to be motivated as directed to press the intervening area of the fabric 20 against the pad 57 for marking the back or jersey face of the fabric. The pad 57 has a kiss-off or applicator surface dimensioned to provide a mark of the desired size on the fabric back when pressed against the pad. As will be observed, the applicator surface of the pad 57 is normally inset relative to guard edges of the holder 58 above and below the pad so that the fabric 20 can freely pass the pad 57 except when pressed against the pad by the thruster 60. Of course, the thruster 60 is dimensioned to freely enter the cavity of the holder 58 within which the pad 57 is mounted during a thrusting operation.

Means are provided for actuating the thruster 60 at predetermined spaced time intervals whereby to effect marking of the fabric 20 to provide, for example, marks M or MB, as the case may be, under suitable control having regard to the desired spacing between applied marks and the speed of operation of the knitting machine. For example, the thruster 60 may comprise the thrusting end of a plunger 61 reciprocatingly guided by guide structure 62 carried by the inside of the baffle flange 25 so that the thruster can operate through a clearance aperture 63 in the flange 25 aligned with the pad 57. Controlled reciprocating operation of the plunger 61 may be effected by means comprising a fluid pressure, e.g. pneumatic, cylinder actuator 64 connected by means of a piston rod 65 to the inner side of the thruster 60, the inner end of the cylinder being connected by means of coupling 67 to a fixed support 68 inside the bell of a baffle 27', the baffle 27' being itself rigidly connected to support 68. Normally the actuator 64 maintains the thruster 60 retracted by means of fluid pressure delivered thereto from a suitable constant pressure source through a conduit 69. To drive the thruster 60 in a marking stroke, means comprising a two-way fluidic valve 70 connected in a pressure line 69 is adapted to be activated as by means of a solenoid 70 to shift the valve 70 against its biasing spring 72 to reverse pressure fluid from the pressure line 69 through a pressure line branch 73 to drive the plunger 61 in a marking stroke. Valve 70 and solenoid 71 can be supported by support 68 adjacent cylinder 64. Timed actuation of the solenoid 71 is adapted to be effected through an electrical energy line 74 which may have counter-timer and control switch and switch actuating means substantially the same as described for operating the solenoid 48 in FIG. 2. Through this arrangement, substantially accurate timed sequence marking of the fabric 20 can be effected to substantially the same effect as with the applicators 42 and 55, FIGS. 1 and 2. It will be appreciated, of course, that the pad applicator 57 and associated mechanism will for the purpose of applying the marks M on the fabric 20 be aligned with the longitudinal slitting area of the tubular fabric, and another similar pad applicator may be located diametrically opposite to the pad applicator 67, 60 for applying the identification marks MB synchronized with application of the identification marks M.

After the fabric 20 has been equipped with the identifications M and MB and has been collected in a stack of sufficient size in the collecting tub 29, the stack of fabric is removed for further processing through a tenter 75 (FIGS. 6 and 8) comprising a tenter frame 75 mounting customary tenter chains 77 having longitudinally spaced pin, clips or other holding means for receiving and holding the opposite side portions or selvages of the fabric, and the chains progressively diverging from respective entrance pulleys 78 at the opposite sides of the entrance end toward maximum width pulleys 79 downstream on the tenter whereby web traveling in the direction indicated by the arrow 80 in FIG. 6 and engaged at its selvages by the opposite tenter chains 77 is progressively stretched from its initial spread apart width W to a desired width W'.

Figure 8:
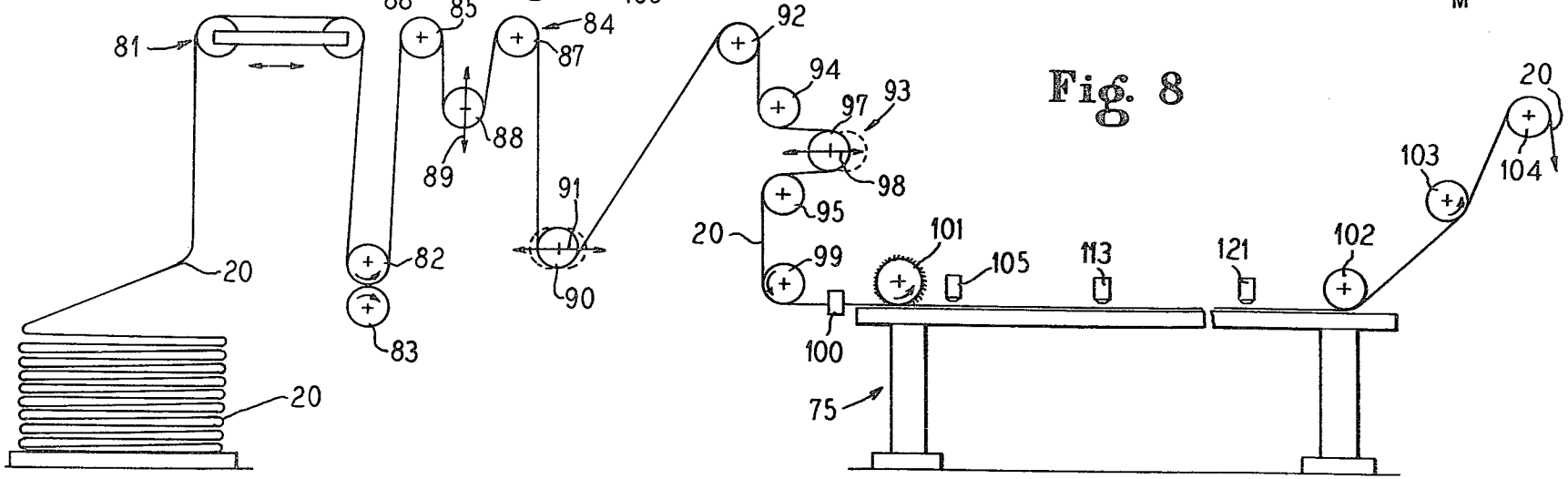
FIG. 8 is a schematic side elevational view related to FIG. 7.

Preliminary to running of the fabric 20 through the tenter 75, it is progressively drawn from a stack as shown at the left of FIG. 8 and, if not already spread out from the tubular knit condition, is spread out and run over a web aligner 81 from which the fabric web or strip is looped about a roller 82 and acted upon by a brush cleaning unit 83. From the roller 82, the fabric strip is run through a tensioning device 84 comprising a pair of horizontally spaced idler rollers 85 and 87 between which the fabric strip is looped downwardly and about a yield adjusting tension roller 88 adapted to be adjusted vertically as indicated by the arrow 89 for adjusting tension in the strip as required. From the tension adjusting device 87, the strip is looped downwardly about a manual skew adjusting roller 90 which is adapted to be swung horizontally as indicated by the directional arrow 91 for manually adjusting any major skew observed in the knit pile fabric strip. Beyond the manual skew adjusting roller 90, the knit fabric strip passes up and over an idler roller 92 and then downwardly through an automatic skew adjusting device 93 comprising vertically spaced rollers 94 and 95, between which the strip is looped over an automatic skew controlling roller 97 which is swingably adjustable as indicated by the arrow 98. Below the idler roller 95, the strip 20 is trained over a guide roller 99 and passes to the tenter 75 to which it is delivered in proper alignment between edge guides 100.

As guided to the entry end of the tenter 75, the knitted fabric 20 is fed to the starting end of the tenter chains 77 which engage the opposite margins of the fabric and begin the progressive transverse stretching of the fabric from the width W to the width W'. Adjacent to the entry or beginning ends of the chains 77, the fabric margins are acted upon by respective brushes 101, as is customary. At the end of the tenter 75, the laterally stretched fabric 20, which may now have been treated to maintain the laterally stretched condition, passes up from an idle roller 102 to a bow controlling roller 103 and then over a cooperating upper idler 104 from which the tentered fabric may run to a winder.

It may be noted that bow correction could be made at the entering end of the tenter 75, by placing the bow controlling roller 103 at that location. Better and more uniform bow control is achieved by having the bow control effective at the discharge end of the tenter.

Figure 7:
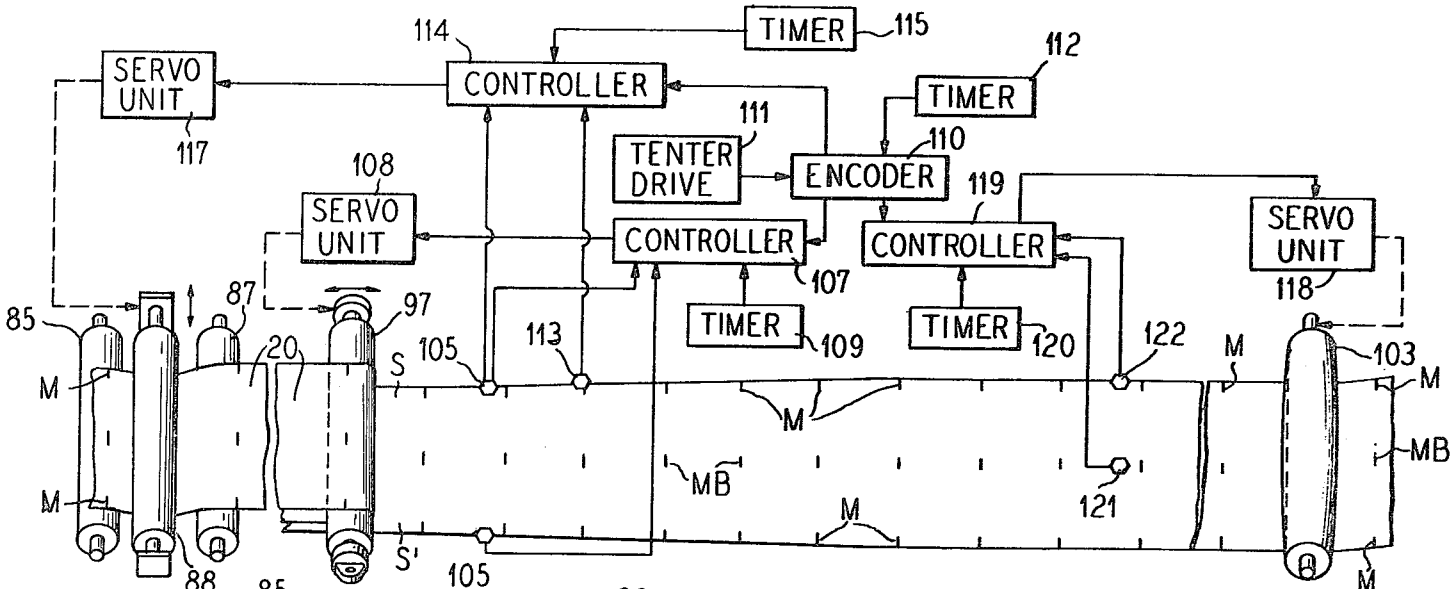
FIG. 7 is a schematic plan view showing in more detail means for controlling skew, bow and yield in the split and spread pile fabric web as it runs to and through the tenter.

Although it is desirable to effect initial manual skew adjustment by means of the manual skew adjusting roll 90, more critical, finer and highly efficient ultimate skew adjustment in the traveling web is desirably effected automatically while the web is running in association with the tenter 75. To this end, means are provided for observing, i.e. scanning, the identification marks M along the opposite selvages S and S' as the fabric strip 20 moves past a given location and noting any skew in the strip as revealed by deviation of the observed identification marks from their predetermined orientation, and operating the skew controlling roll 97 to correct the revealed skew. By virtue of the identification marks M being located on respective common courses of the fabric 20 so that when those courses are at straight right angles to the longitudinal axis of the fabric, a skew-free condition of the fabric will have the companion marks M on the opposite selvages S and S' aligned in substantially true right angular relation relative to the longitudinal axis of the fabric strip. However if at the selected location for skew condition observation, either of a pair of course aligned marks M is ahead or behind the other and thus indicative of a skew condition in the strip, corrective action may be taken by operating the skew adjusting roller 97. For this purpose, a pair of scanning devices 105 is mounted at the selected skew observation location, one of the scanners 105 being positioned to scan the selvage S and the other being positioned to scan the selvage S'. The positions of the scanners 105 is, consistent with the optimum alignment of the identification marks M, in right angular alignment with the longitudinal axis of movement of the fabric strip 20. A desirable location for the scanners 105 is adjacently downstream from the brushes 101 as best seen in FIGS. 6 and 8. The scanners 105 should, of course, be selected for observing and responding to the particular nature of the identification marks M. A suitable electric eye type of scanner will generally be satisfactory. Such scanners are well-known and readily available from various sources and operate on the principle of generating a signal which is amplified and employed to activate servomechanism for actuating control means for the intended purpose. By way of example, the scanners 105 are schematically depicted in FIG. 7 as electrically coupled by means of a controller 107 with a servo unit 108 operatively coupled with the skew adjusting roller 97 (FIGS. 6 and 7). Coupled to the controller 107 is a timer 109. Also coupled to the controller 107 is an encoder 110 (FIGS. 6 and 7) driven by means of tenter drive 111 which also drives the tenter chains 77 through the pulleys 79. A timer 112 is coupled with the encoder 110. It will be appreciated that the timers 109 and 112 are useful in timing and synchronization in the control system. Through this arrangement, skew deviations are automatically corrected in the traveling knit pile fabric strip 20.

Means are also provided for automatically correcting yield in the traveling web 20. For this purpose, means are provided for observing the distance between successive identification marks M along at least one of the selvages of the moving fabric strip 20, herein the selvage S. Such observing is effected by cooperation of a sensing device or scanner 113 located in suitably longitudinally spaced relation to the adjacent cooperating sensor 105 along the path of the selvage S. Both sensor 113 and the cooperating sensor 105 are coupled with a controller 114 which is also coupled with the encoder 110 and has a timer 115 and controls the operation of a servo unit 117 operatively connected with the tension adjusting roll 88. The cooperating scanners 105 and 113 are so located relative to one another and to the predetermined preferred spacing between the successive detectable identification marks M on the selvage S to note, i.e. detect, deviation in spacing from a predetermined spacing between the marks M, and which deviation results from undesirable variation in tension in the running fabric strip 20. Such variation is signaled by the detecting scanners 105 and 113 to the controller 114 which activates the servo unit 117 to adjust the tension roller 88 up or down as indicated by the directional arrow 89 in FIG. 8 to adjust and alter the tension in the running fabric strip sufficiently to alleviate the noted deviation in the spacing and thereby attaining uniform yield in the running strip.

Means are also provided for automatically adjusting for bow in the traveling fabric strip 20 through operation of the bow controlling roller 103. For this purpose, the roller 103 is desirably of an intermediately bulged or bowed peripheral configuration, as best visualized in FIG. 7 and means are provided for controlling rotation of the roll 103 when bowing deviations are detected in the running fabric strip 20. By way of example, such control of the bow adjusting roll 103 is effected by means of a servo unit 118 coupled to a controller 119 which similarly as to other controllers is operatively connected to the encoder 110 and has a timer 120. For signaling the controller 119 as to any bow deviation noted in the running fabric strip 20, appropriate scanning means are provided comprising a detecting scanner 121 connected to the controller. The scanner 121 is located in a position preferably near the leaving end of the tenter 75 to scan the successive bow control identification marks MB on the longitudinal central area of the strip 20. Also connected to the controller 119 is a reference scanner 122 which is positioned in proper transverse alignment with the scanner 121 to read the identification marks M along one of the selvages, herein the selvage S. By having the scanners 121 and 122 aligned with one another at right angles to the longitudinal axis of the running strip 20, any deviation of transversely aligned bow controlling marks MB relative to the scanned selvage identification marks M will cause the scanners 121 and 122 to signal the controller which in turn will operate the servo unit 118 to modify the rotary travel of the bow adjusting roller 103 relative to the running strip 20 to correct the bow deviation.

From the foregoing, it will be readily apparent that the problems of skew, yield and bow in the circularly knit pile fabric 20 are efficiently and continuously corrected incident to tentering of the strip, whereby imperfections attributable to those conditions are substantially eliminated in the end product.

It will be understood that variations and modifications may be effected without departing from the spirit and scope of the novel concepts of this invention.

I claim as my invention:

1. Apparatus for detecting fabric markings and controlling yield in a knit fabric strip to facilitate tentering of said fabric strip, said fabric strip having a first set of detectable identifications longitudinally along a longitudinal side edge thereof, each identification of said set being in a predetermined longitudinal spacing interval relative to others thereof, said apparatus comprising:

means for receiving and longitudinally advancing said fabric strip;

first detecting means for sensing yield variations longitudinally in said advancing fabric strip as measurable by deviations in spacing between successive ones of said spaced intervals;

longitudinal tension altering means for varying tension longitudinally along said fabric strip, control means responsive to said first detecting means for measuring any variations from a predetermined value and for regulating operation of said tension altering means, and tentering means downstream from said tension altering means for receiving and engaging opposed side edges of said advancing fabric strip.

2. Apparatus according to claim 1 wherein said advancing strip of circularly knit pile fabric additionally has a set of skew control identifications along the opposed longitudinal side edge thereof in addition to said detectable identifications and means for detecting undesirable skew conditions in said advancing fabric strip and wherein said apparatus includes second detecting means for detecting deviations in transverse alignment of opposed pairs of said identifications, and means for differentially moving opposed side edges of said fabric strip to bring said opposed identifications into a predetermined alignment, control means for responding to said undesirable skew conditions and for operating said differentially moving means.

* * * * *